US011174582B2

(12) United States Patent
Lv et al.

(10) Patent No.: US 11,174,582 B2
(45) Date of Patent: Nov. 16, 2021

(54) WASHING MACHINE

(71) Applicants: CHONGQING HAIER DRUM WASHING MACHINE CO., LTD., Shandong (CN); HAIER SMART HOME CO., LTD., Shandong (CN)

(72) Inventors: Peishi Lv, Shandong (CN); Sheng Xu, Shandong (CN); Yanfen Lv, Shandong (CN); Xinghui Hao, Shandong (CN); Di Wu, Shandong (CN)

(73) Assignees: CHONGQING HAIER DRUM WASHING MACHINE CO., LTD., Chongqing (CN); HAIER SMART HOME CO., LTD., Shandong (CN)

( * ) Notice: Subject to any disclaimer, the term of this patent is extended or adjusted under 35 U.S.C. 154(b) by 62 days.

(21) Appl. No.: 16/604,774

(22) PCT Filed: Apr. 12, 2018

(86) PCT No.: PCT/CN2018/082847
§ 371 (c)(1),
(2) Date: Oct. 11, 2019

(87) PCT Pub. No.: WO2018/188634
PCT Pub. Date: Oct. 18, 2018

(65) Prior Publication Data

US 2020/0123695 A1 Apr. 23, 2020

(30) Foreign Application Priority Data

Apr. 12, 2017 (CN) ..... 201710242046.8

(51) Int. Cl.
*D06F 39/08* (2006.01)
*D06F 37/24* (2006.01)
*D06F 37/26* (2006.01)

(52) U.S. Cl.
CPC ..... *D06F 39/083* (2013.01); *D06F 37/24* (2013.01); *D06F 37/268* (2013.01); *D06F 39/08* (2013.01); *D06F 39/081* (2013.01)

(58) Field of Classification Search
CPC ..... D06F 39/08; D06F 39/081; D06F 39/083; D06F 37/24; D06F 37/268
See application file for complete search history.

(56) References Cited

U.S. PATENT DOCUMENTS 2,554,229 A * 5/1951 Woodson ..... D06F 13/02 68/23.5
4,584,732 A * 4/1986 Kohsaka ..... D06F 23/04 68/12.23

(Continued)

FOREIGN PATENT DOCUMENTS

CN 202380548 U 8/2012
CN 203065831 U 7/2013

(Continued)

OTHER PUBLICATIONS

International Search Report (PCT/ISA/210), with translation, and Written Opinion (PCT/ISA/237) dated Jul. 18, 2018, by the Chinese Patent Office as the International Searching Authority for International Application No. PCT/CN2018/082847.

(Continued)

*Primary Examiner* — Joseph L. Perrin
(74) *Attorney, Agent, or Firm* — Buchanan Ingersoll & Rooney PC

(57) ABSTRACT

A washing machine belongs to the field of washing machines and comprises a water collection structure for stopping water drained from an inner tub out of overflowing and a drainage structure for draining the water in the water collection structure, the inner tub comprises a tub body and a tub bottom arranged at a lower part of the tub body, the water collection structure is located outside the tub bottom (Continued)

of the inner tub. The spacing distance between the tub body and a case body of washing machine is greater by locating the water collection structure outside the tub bottom of the inner tub, so that greater-extent capacity expansion may be realized, and the washing machine is reasonable in design, simple in structure and low in cost.

18 Claims, 3 Drawing Sheets

(56) References Cited

U.S. PATENT DOCUMENTS

| | | | | |
|---|---|---|---|---|
| 6,929,270 | B1 * | 8/2005 | Flagstad | D06F 39/12 280/79.11 |
| 2013/0031938 | A1 * | 2/2013 | Cho | D06F 13/02 68/133 |
| 2013/0036776 | A1 * | 2/2013 | Seo | D06F 37/206 68/18 F |
| 2015/0052954 | A1 * | 2/2015 | Erickson | D06F 17/06 68/17 R |
| 2017/0030002 | A1 * | 2/2017 | Alexander | D06F 23/04 |

FOREIGN PATENT DOCUMENTS

| | | | |
|---|---|---|---|
| CN | 204138930 | U | 2/2015 |
| CN | 204589626 | U | 8/2015 |
| CN | 105568616 | A | 5/2016 |
| CN | 105603673 | A | 5/2016 |
| CN | 106149270 | A | 11/2016 |
| CN | 205775351 | U | 12/2016 |
| CN | 205856866 | U | 1/2017 |
| EP | 2423368 | A1 | 2/2012 |
| JP | 50-138858 | | 4/1975 |
| JP | 54-47273 | | 9/1979 |
| JP | 55-33118 | | 8/1980 |
| JP | 2004-317454 | A | 11/2004 |
| JP | 2015054158 | A | 3/2015 |

OTHER PUBLICATIONS

Notice of Reasons for Refusal issued in corresponding Japanese Patent Application No. 2019-555648, dated Jun. 28, 2021, with English Translation (8 pages).

* cited by examiner

WASHING MACHINE

TECHNICAL FIELD

The present disclosure belongs to the field of washing machines and specifically relates to a washing machine.

BACKGROUND

A washing machine is designed to be a apparatus for washing clothes by using electricity, generally speaking, the washing machine comprises a tub for accommodating washing water; a rotating tub rotatably mounted inside the tub, an pulsator rotatably mounted at the bottom of the rotating tub as well as a motor and a clutch which are configured to drive the rotating tub and the pulsator to rotate. The pulsator and the clothes introduced to the rotating tub stir the washing water together when the rotating tub and the pulsator rotate in the state that the clothes and a detergent are introduced to the rotating tub, so that stains are removed from the clothes.

In order to increase the washing capacity of the washing machine, a larger rotating tub is required, namely the height or diameter of the rotating tub is required to be increased. If the size of the rotating tub is larger, the tub accommodating the rotating tub and a housing accommodating the tub are also required to be enlarged with the enlargement of the rotating tub.

The enlargement of the housing corresponding to the appearance of the washing machine is limited by the space for mounting the washing machine, a position for mounting the washing machine in the house of an ordinary user is generally limited, it is unrealistic to achieve the aim of increasing the capacity of a washing tub by enlarging the housing of the washing machine, and therefore, how to increase the capacity of the rotating tub on the premise that the housing of the washing machine is not enlarged becomes a big problem puzzling a designer.

In order to increase the capacity of an inner tub, a water collection structure used for collection water in the inner tub is arranged in the washing machine, the water collection structure is arranged at the lower part of the inner tub and is used for collection water drained from the inner tub, the space at the lower part of the inner tub is limited under the influence of the size of the washing machine, which results in volume limitation of the water collection structure. If the drainage design is not good, it will often cause overflow and damage electrical elements at the lower part of the washing machine or result in ground wetness and slip. Therefore, how to design the drainage of the water collection structure on the premise that the capacity of the inner tub is increased becomes a huge problem at present.

For this purpose, the present disclosure is proposed.

SUMMARY

The technical problem to be solved by the present disclosure is to overcome defects in the prior art and provide a washing machine. Due to the arrangement of a drainage structure in a normally-open state and the arrangement that the highest point of the drainage structure is lower than that of a water collection structure, water in the water collection structure is constantly drained by the drainage structure under the action of gravity, so that the phenomenon that the water in the water collection structure overflows due to an overhigh water level is avoided; and the design structure can drain the water in the water collection structure without adding other parts. The design is reasonable, the structure is simple, and the cost is low. In order to solve the technical problem, the basic concept of the technical solution adopted by the present disclosure is that:

a washing machine comprises an inner tub for accommodating water, a water collection structure for stopping water drained out of the inner tub from overflowing and a drainage structure for draining the water in the water collection structure, the inner tub comprises a tub body and a tub bottom arranged at a lower part of the tub body, and the water collection structure is located outside the tub bottom of the inner tub.

The water collection structure is integrally located below the tub bottom of the inner tub, and the drainage structure is in a normally-open state.

The water collection structure comprises a water collection cavity with an upper opening, an upper end of a side wall of the water collection cavity is lower than a tub bottom of the inner tub, the inner tub is communicated with the upper opening of the water collection cavity, the drainage structure comprises a drainage pipe, the drainage pipe is connected with a wall of the water collection cavity, and the upper opening of the water collection cavity is higher than a highest point of the drainage pipe;

preferably, the drainage pipe is connected with a bottom wall of the water collection cavity and keeps a normally-open state.

The water collection structure comprises a mounting plate and a water retaining bar arranged on the mounting plate, the water collection cavity is formed by the mounting plate and the water retaining bar, a first drainage outlet for draining the water in the water collection cavity is formed in the mounting plate, and a water inlet end of the drainage pipe is communicated with the first drainage outlet, and an upper end of the water retaining bar is higher than the highest point of the drainage pipe.

A junction of the drainage structure and the water collection structure is higher than the highest point of the drainage pipe, and the water in the water collection structure is drained out of the washing machine under the action of gravity;

preferably, the first drainage outlet is higher than the highest point of the drainage pipe.

The water inlet end of the drainage pipe is connected with the bottom wall of the water collection cavity, a water outlet end of the drainage pipe directly extends out of the washing machine, and the water inlet end of the drainage pipe is higher than the water outlet end of the drainage pipe;

preferably, the height of the drainage pipe is gradually reduced from the water inlet end to the water outlet end.

The junction of the water collection structure and the drainage structure is provided with a buffering cavity for buffering and reducing the speed of water flow entering the drainage pipe from the water collection structure;

preferably, the buffering cavity is arranged at a junction of the water collection cavity and the drainage pipe.

The bottom wall of the water collection cavity is downwards sunk to form the buffering cavity, and the first drainage outlet is formed in the wall of the buffering cavity;

preferably, the bottom wall of the water collection cavity is downwards sunk to form a cavity provided with a bottom wall and a side wall, and the first drainage outlet is formed in a bottom wall of the cavity.

The side wall of the cavity is an inclined plane and is gradually shrunk towards an axis direction of the cavity along water flow direction.

The drainage pipe comprises the water inlet end and a body, and a diameter of the water inlet end is larger than a diameter of the body to form the buffering cavity at the water inlet end of the drainage pipe;

and the diameter of the water inlet end is gradually shrunk along the water flow direction up to the diameter of the body to form the inclined plane.

The washing machine further comprises a main control apparatus and a normally-open electromagnetic valve, the normally-open electromagnetic valve is arranged on the drainage pipe and communicated with the drainage pipe, and the normally-open electromagnetic valve is electrically connected with the main control apparatus.

After the technical solution is adopted, compared with the prior art, the washing machine has the following beneficial effects that: (1) due to the arrangement of the water collection structure, on the one hand, the water is blocked by the water collection structure when being drained from the inner tub, so that the water is prevented from overflowing, and on the other hand, the water collection structure is integrally located under the inner tub, so that the water collection structure is not provided with parts of structures located between the inner tub and the casebody, there are no effects on limitting the capacity expansion of the inner tub, and a sufficient space is provided for the capacity expansion of the inner tub; (2) due to the arrangement of the drainage structure in the normally-open state and the arrangement that the highest point of the drainage structure is lower than that of the water collection structure, the water in the water collection structure is constantly drained by the drainage structure under the action of gravity, so that the phenomenon that the water in the water collection structure overflows due to an overhigh water level is avoided; and (3) due to the adoption of the design structure, the water in the water collection structure may be drained without adding other parts, and the washing machine is reasonable in design, simple in structure and low in cost.

The detailed embodiments of the present disclosure are further described in detail below in combination with accompanying drawings.

BRIEF DESCRIPTION OF THE DRAWINGS

Serving as a part of the present disclosure, the accompanying drawings are used for further understanding the present disclosure, the illustrative embodiments and the descriptions thereof in the present disclosure intend to explain the present disclosure, rather than improperly limit the present disclosure. It is apparent that the accompanying drawings described below are only some embodiments, and other accompanying drawings may also be obtained by the ordinary skill in the art according to the accompanying drawings on the premise that no creative labor is provided. In the accompanying drawings.

Figure 1:
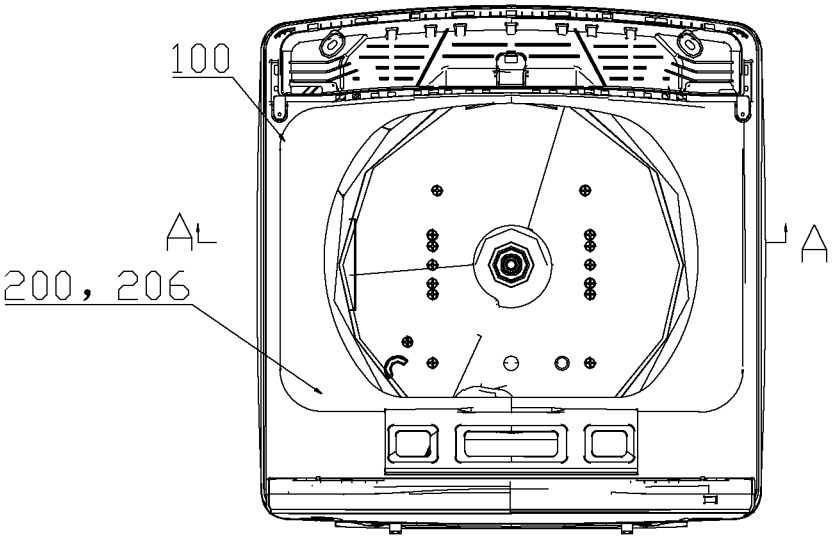
FIG. 1 is a vertical view structural schematic diagram of a washing machine provided by the present disclosure.
Figure 2:
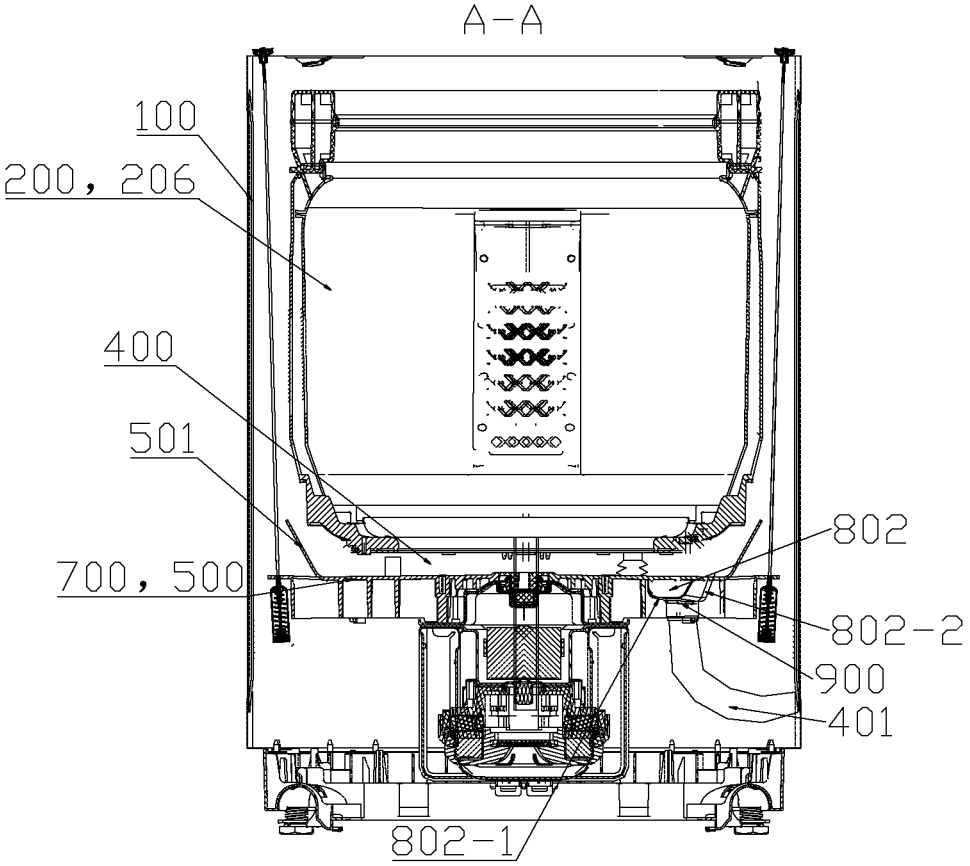
FIG. 2 is an A-A direction sectional structural schematic diagram of the washing machine with a direct drainage structure in the present disclosure in FIG. 1.

In the figures, 100—case body, 200—inner tub, 201—third drainage port, 202—first drainage pipeline, 203—water outlet, 204—second drainage port, 205—blocking apparatus, 205-1—valve plug, 205-2—electromagnetic apparatus, 206—washing tub, 300—driving apparatus, 301—motor, 302—deceleration clutch apparatus, 303—output shaft, 400—water collection cavity, 401—drainage pipe, 500—mounting plate, 501—water retaining bar, 600—suspended vibration absorption member, 601—vibration absorption unit, 602—suspender, 700—mounting piece, 700-1—big mounting plate, 700-2—small mounting plate, 701—mounting portion, 703—first vibration absorption member, 704—second vibration absorption member, 800—main control apparatus, 801—control structure, 802—buffering cavity, 802-1—bottom wall of cavity, 802-2—side wall of cavity and 900—first drainage outlet.

It should be explained that the accompanying drawings and text description intend to explain the concept of the present disclosure to the skilled in the art by referring to specific embodiments, rather than to limit the conceive scope of the present disclosure in any form.

DETAILED DESCRIPTION

In order to make the objects, technical solutions and advantages of embodiments of the present disclosure clearer, the technical solutions in the embodiments are clearly and completely described below in combination with the accompanying drawings in the embodiments of the present disclosure, and the following embodiments only intend to describe the present disclosure, rather than to limit the scope of the present disclosure.

Embodiment 1

As shown in FIG. 1 to FIG. 4, a washing machine comprises an inner tub 200, the inner tub 200 is a water holding tub, the washing machine further comprises a water collection structure for stopping water drained from the inner tub 200 from overflowing and a drainage structure used for draining the water in the water collection structure, the inner tub 200 comprises a tub body and a tub bottom arranged at the lower part of the tub body, and the water collection structure is located outside the tub bottom of the inner tub. The tub body and the tub bottom of the inner tub are connected to jointly form the inner tub, and the water collection structure is located outside the tub bottom of the inner tub.

The water collection structure is integrally located at the lower part of the tub bottom of the inner tub 200, and the drainage structure is in a normally-open state when the washing machine is in a normal running state. The tub bottom of the inner tub comprises a bottom wall and a flanging arranged at the upper part of the bottom wall, the flanging is arranged around the bottom wall, the bottom wall and the flanging jointly form the tub bottom of the inner tub, and the lower part of the tub body and the upper part of the flanging are connected to jointly form the inner tub. The water collection structure is not higher than the upper edge of the flanging to be integrally located at the lower part of the tub bottom of the inner tub.

Wherein, the highest point of the drainage structure is lower than that of the water collection structure, and the water in the water collection structure is automatically drained by the drainage structure under the action of gravity; or the water in the drainage structure may be pumped out by a water pump.

The washing machine further comprises a case body 100 and a driving apparatus 300 for driving the inner tub 200 to rotate.

Due to the arrangement of the water collection structure, on the one hand, the water is blocked and collected by the water collection structure when being drained from the inner tub 200, so that the water is prevented from overflowing, and on the other hand, the water collection structure is integrally located under the inner tub 200, so that the water collection structure is not provided with parts of structures located between the side wall of the inner tub 200 and the case body 100, there are no effects on limitting the capacity expansion of the inner tub 200, and a sufficient space is provided for the capacity expansion of the inner tub 200.

Further, the water collection structure comprises a water collection cavity 400 with an upper opening, the upper end of the side wall of the water collection cavity 400 is lower than the tub bottom of the inner tub 200, the inner tub 200 is communicated with the upper opening of the water collection cavity 400, the drainage structure comprises a drainage pipe 401, the drainage pipe 401 is is connected with the wall of the water collection cavity 400, and the upper opening of the water collection cavity 400 is higher than the highest point of the drainage pipe 401.

Due to the arrangement of the water collection cavity 400, the water drained from the inner tub 200 is blocked, the upper end of the side wall of the water collection cavity 400 is lower than the tub bottom of the inner tub 200 to ensure that the water collection cavity 400 is integrally located under the tub bottom of the inner tub, so that the side wall of the water collection cavity 400 is not provided with structures located between the inner tub 200 and the case-body 100, setting a certain safety distance between the inner tub 200 and the water collection structure is not needed, the phenomenon that the inner tub 200 comes into collision against the water collection structure to result in damage is avoided, meanwhile, setting the safety distance between the water collection structure and the casebody 100 again is not needed, and therefore, the safety distance between the inner tub 200 and the casebody 100 is only required to be designed, the diameter of the inner tub 200 may be greatly increased, and the capacity expansion of the inner tub 200 may be better realized.

The water is drained out of the water collection cavity 400 by communicating the drainage pipe 401 with the wall of the water collection cavity 400, meanwhile, the upper opening of the water collection cavity 400 is higher than the highest point of the drainage pipe 401, and thus, the water in the water collection cavity 400 flows downstream under the action of gravity so as to be automatically drained.

A second drainage portsecond drainage port 204 is formed in the lower part of the inner tub 200 so that the water in the inner tub 200 may be drained into the water collection structure, the washing machine comprises a blocking apparatus 205 used for blocking the second drainage portsecond drainage port 204, during water feeding and washing states, the second drainage portsecond drainage port 204 is plugged by the blocking apparatus 205 so that the inner tub 200 holds water to wash clothes, during drainage and dewatering, the blocking apparatus 205 is unplugged so that the water is drained into the water collection cavity 400 of the water collection structure. During water feeding, if a water level control element such as a flow meter has a fault, the water may flow into the water collection cavity 400 through the top of a balance ring along the wall of the inner tub 200, and the water may be constantly fed so as to overflow out of the water collection cavity 400; or during dewatering and drainage, washing water in the inner tub 200 enters the water collection cavity 400 from the inner tub 200, and a liquid may overflow out of the water collection cavity 400 if the liquid is excessive; or if the blocking apparatus 205 between the inner tub 200 and the water collection cavity 400 is damaged in a washing process, the washing water enters the water collection cavity 400 from the inner tub 200 to result in water feeding continuity so that the water may overflow out of the water collection cavity 400, and all the three situations as mentioned above may result in the phenomenon that the water overflows to the ground to result in ground wetness and slip or overflows to an electrical apparatus at the bottom of the washing machine to damage the electrical apparatus.

The drainage structure is arranged, the water in the water collection structure is drained, the drainage structure is in the normally-open state, and the highest point of the drainage structure is lower than that of the water collection structure, the water in the water collection structure is drained by the drainage structure under the action of gravity, so that the structural design is reasonable, parts are not needed to be additionally arranged, and furthermore, the cost is greatly reduced; in addition, the water collection structure is arranged at the lower part of the tub bottom of the inner tub, the water collection capacity of the water collection structure is limited due to spatial limitation, and therefore, a little carelessness may result in overflow, constant drainage may be realized due to the arrangement of the drainage structure capable of directly draining the water, so that the water in the water collection structure may not be accumulated to reach a relatively high water level, and furthermore, the overflow risk is greatly reduced.

Further, the drainage pipe 401 is connected with the bottom wall of the water collection cavity 400 and keeps the normally-open state, so that the water in the water collection cavity 400 is completely drained without residues, the performance of the water collection cavity 400 may not be affected, and meanwhile, the water may be constantly drained due to the adoption of the normally-open state.

Further, the water collection structure comprises a mounting plate 500 and a water retaining bar 501 arranged on the mounting plate 500, the water collection cavity is formed by the mounting plate 500 and the water retaining bar 501, a first drainage outlet 900 used for draining the water in the water collection cavity 400 is formed in the mounting plate 500, and the water inlet end of the drainage pipe 401 communicates with the first drainage outlet 900, and the upper end of the water retaining bar 501 is higher than the highest point of the drainage pipe 401. The water collection cavity 400 is formed by the mounting plate 500 and the water retaining bar 501, so that the structure is simple, and machine shaping is convenient to realize, the water retaining bar 501 and the mounting plate 500 may be integrally formed into the water collection cavity 400 or may be formed into the water collection cavity 400 in other fixing ways (such as bonding), the upper end of the water retaining bar 501 is higher than the highest point of the drainage pipe 401, so that the water in the water collection cavity 400 may be automatically drained under the action of gravity.

Further, a junction of the drainage structure and the water collection structure is higher than the highest point of the drainage pipe 401, and the water in the water collection structure is automatically drained out of the washing machine under the action of gravity; after the junction is enabled to be higher than the highest point of the drainage pipe 401 and the water in the water collection structure is drained from the junction, a potential energy rising stage is omitted, so that the water drainage resistance is reduced, and furthermore, the water is more smoothly drained from the water collection structure.

Further, the first drainage outlet 900 is higher than the highest point of the drainage pipe 401, and therefore, after the water is drained from the first drainage outlet 900, the potential energy is gradually reduced, and the water is drained more rapidly.

Further, the water inlet end of the drainage pipe is connected with the bottom wall of the water collection cavity, the water outlet end of the drainage pipe directly extends out of the washing machine, no other parts are arranged for drainage, and the water inlet end of the drainage pipe 401 is higher than the water outlet end of the drainage pipe 401.

Further, the height of the drainage pipe 401 is gradually reduced from the water inlet end to the water outlet end, so that the position where the flow changes direction is reduced, the potential energy is gradually reduced, and the water is drained more smoothly.

Further, the junction of the water collection structure and the drainage structure is provided with a buffering cavity 802 used for buffering and reducing the speed of water flow entering the drainage pipe 401 from the water collection structure. The water collection structure and the drainage structure are generally detachably connected in a way such as snap connection, spliced connection or threaded connection, if the water flow speed is overhigh, the junction of the drainage structure and the water collection structure is easy to deform due to overhigh shock to result in water leakage, and even the drainage structure falls off from the water collection structure, in order to avoid the problem, the junction of the drainage structure and the water collection structure is provided with the buffering cavity 802, and the danger is reduced due to a buffering effect of the buffering cavity 802.

Further, the buffering cavity 802 is arranged at the junction of the water collection cavity 400 and the drainage pipe 401.

Solution 1: the bottom wall of the water collection cavity 400 is downwards sunk to form the buffering cavity 802, and the first drainage outlet 900 is formed in the wall of the buffering cavity 802, the water flow is made to firstly enter the buffering cavity 802, the phenomenon that the drainage structure falls off due to overhigh shock of the water flow to the junction of the water collection structure and the drainage structure is avoided due to the buffering effect of the buffering cavity 802, the first drainage outlet 900 is formed in the wall of the buffering cavity to make the water entering the buffering cavity 802 completely drained, so that the damage of water to the buffering cavity 802 is reduced.

Further, the bottom wall of the water collection cavity 400 is downwards sunk to form a cavity provided with a bottom wall and a side wall, and the first drainage outlet 900 is formed in the bottom wall 802-1 of the cavity, so that water is prevented from being stored in the cavity.

Further, the side wall 802-2 of the cavity is an inclined plane and is gradually shrunk towards an axis direction of the cavity along a water flow direction to gradually change the water flow, so that the water flow slowly enters the cavity.

Solution 2: the drainage pipe comprises a water inlet end, a water outlet end and a body arranged between the water inlet end and the water outlet end, and the diameter of the water inlet end is larger than the pipe diameter of the body to form the buffering cavity 802 at the water inlet end of the drainage pipe 401.

Further, the diameter of the water inlet end of the drainage pipe 401 is gradually shrunk along the water flow direction to reach the diameter of the body of the drainage pipe 401 so as to form the inclined plane.

Wherein, the edge of the first drainage outlet 900 downwards extends to form a tubular structure with external threads, the water inlet end of the drainage pipe is provided with internal threads, and the tubular structure and the drainage pipe are in threaded connection so that the drainage pipe is fixedly arranged on the water collection structure.

Figure 3:
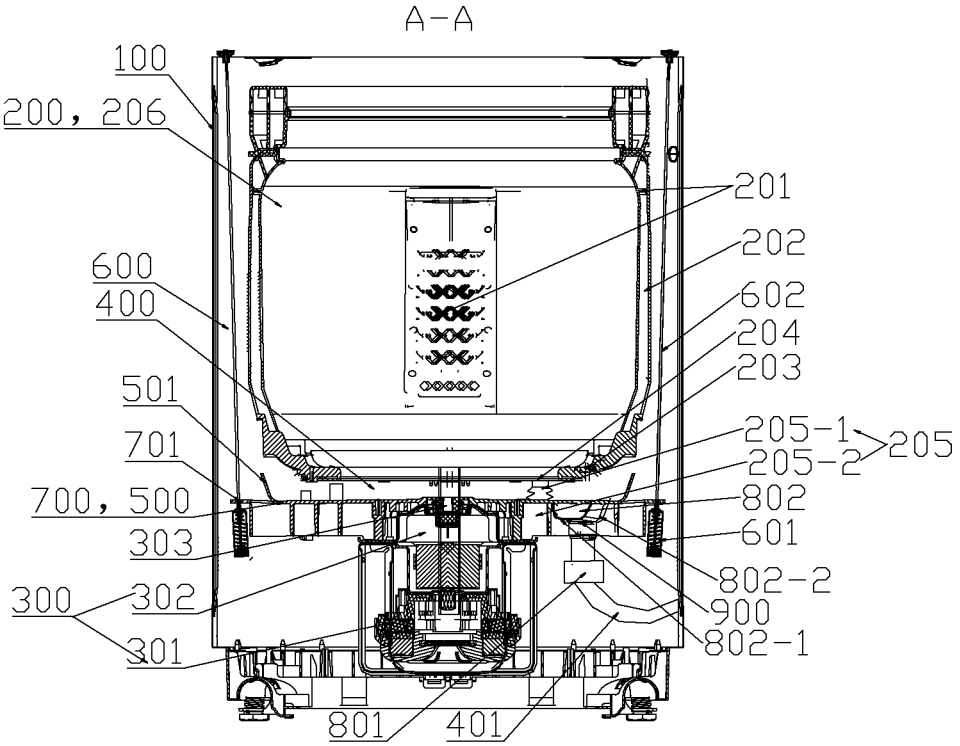
FIG. 3 is an A-A direction sectional structural schematic diagram of the washing machine provided with a control structure in the present disclosure in FIG. 1.
Figure 4:
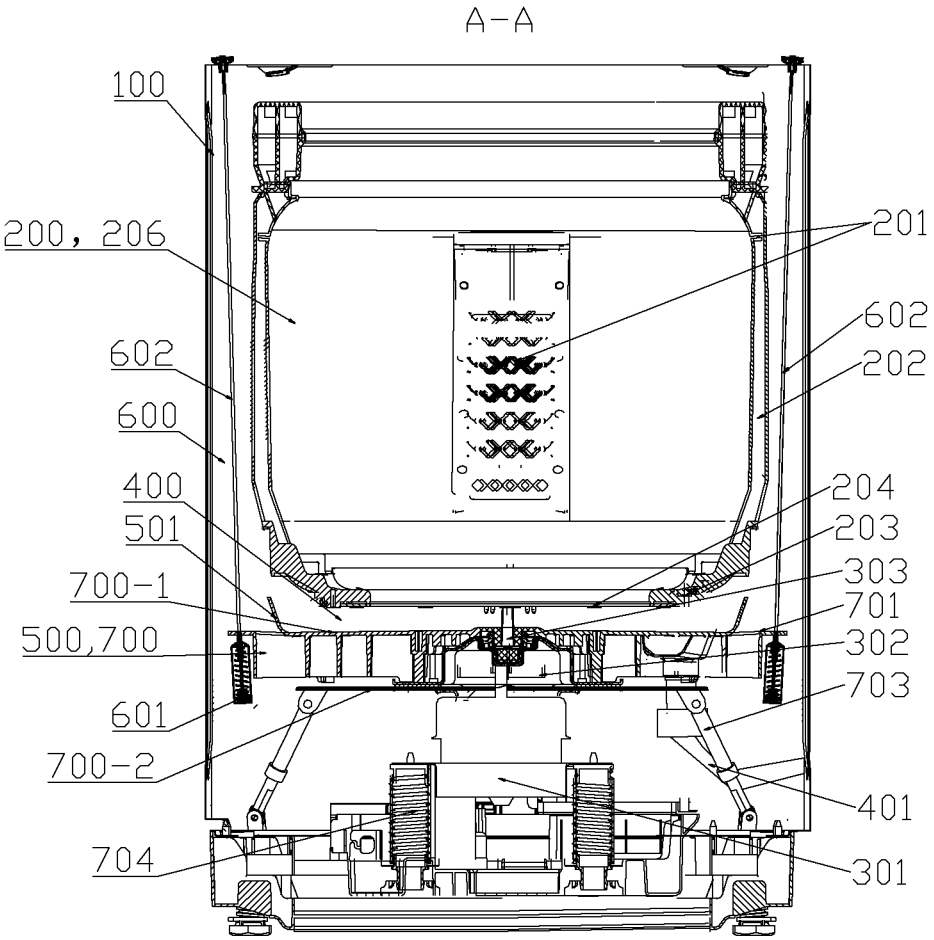
FIG. 4 is an A-A direction sectional structural schematic diagram of a washing machine with the other structure in the present disclosure.

Further, as shown in FIG. 3, the washing machine further comprises a control structure 801 which may be started/stopped, the control structure 801 is arranged on the drainage structure and communicates with the drainage structure, the control structure 801 is in a normally-open state, and the control structure 801 is in a started state when the washing machine is in a normal running state, so that the drainage structure is in a conducted state, and the water may be constantly drained from the water collection structure under the action of gravity;

and when the washing machine has a fault or is unsuitable for drainage, the control structure 801 is closed, so that the drainage structure is cut off, and water may not flow out.

Solution 1: the washing machine further comprises a main control apparatus 800, the control structure 801 is electrically connected with the main control apparatus 800, and the control structure 801 is a normally-open electromagnetic valve communicating with the drainage pipe 401.

When the washing machine is in a normal state, the normally-open electromagnetic valve is in an open state, so that the drainage pipe 401 is in the conducted state, and the water in the water collection structure may be constantly drained, and when the washing machine is in a fault state or the washing water is unsuitable for drainage, the main control apparatus 400 controls the normally-open electromagnetic valve to be closed, and the normally-open electromagnetic valve is opened again after the fault is removed, so that the washing machine normally drains water.

Solution 2: the control structure 801 may also be a mechanical valve, and the mechanical valve is in the open state all the time when the washing machine is in the normal state and is manually closed when the washing machine has the fault.

Further, the drainage pipe is internally provided with a filter screen, the drainage pipe is easily blocked by the direct drainage structure, and therefore, the drained water may be filtered by arranging the filter screen in the drainage pipe, so that the drainage pipe is prevented from being blocked, and the service life is prolonged.

The filter screen is detachably connected with the inner wall of a drainage pipeline so as to be convenient to clean, and snap connection or threaded connection may be adopted.

Wherein, a certain distance is spaced between the side wall of the water collection cavity 400 and the outer wall of the tub bottom of the inner tub 200.

Due to the arrangement that the upper end of the side wall of the water collection cavity 400 is lower than the tub bottom of the inner tub 200 and a certain distance is spaced between the side wall of the water collection cavity 400 and the outer wall of the tub bottom of the inner tub 200, a washing tub 206 comes into collision against the side wall of the water collection cavity 400 during vibration, so that the service life of the water collection cavity 400 is prolonged.

The inner tub 200 comprises a third drainage port 201 used for drainage during spin-drying and a first drainage pipeline 202 communicating with the third drainage port 201, and a water outlet 203 of the first drainage pipeline 202 communicates with the water collection structure. The water in the washing tub 206 is drained into the water collection structure by the first drainage pipeline 202 communicating with the third drainage port 201, and furthermore, the water is drained by the drainage pipe 401.

Embodiment II

As shown in FIGS. 1 to 4, the present embodiment is a further limitation to Embodiment I. In the present embodiment, the water collection structure includes a mounting plate 500 and a water retaining bar 501 arranged on the mounting plate 500. The mounting plate 500 and the water retaining bar 501 define a water collection cavity 400. By arranging the mounting plate 500 and the water retaining bar 501 and forming the water collection cavity 400 by the mounting plate 500 and the water retaining bar 501, the structure is simple and convenient to machine.

The water collection cavity 400 is located at the middle part of the mounting plate 500, so that the gravity center of a water retaining apparatus overlaps the center more easily, and an offset is reduced.

The water retaining bar 501 is of a ring shape, and the water retaining bar 501 and the mounting plate 500 define a annular water collection cavity 400.

Further, the water retaining bar 501 is inclined. By tilting the water retaining bar 501, the water retaining volume may be increased to the maximum extent, and the use is more convenient.

Further, the water retaining bar 501 gradually contracts from top to bottom towards a center axis direction of the water collection cavity 400, so that the upper opening has a larger aperture, which is more favorable for collection.

Further, the outer wall of the bottom of the inner tub 200 is an arc-shaped surface, and a certain distance is reserved between the water retaining bar 501 and the arc-shaped surface of the inner tub 200.

Further, a projection of the inner tub 200 in a horizontal direction covers a projection of the water collection cavity 400 in the horizontal direction. Since the projection of the inner tub 200 in the horizontal direction covers the projection of the water collection cavity 400 in the horizontal direction, the distance between the water collection cavity 400 and the case body 100 is prolonged, so as to prevent the collision of the water collection cavity 400 to the case body 100 and reduce damage to the water collection cavity 400. Meanwhile, the small water collection cavity 400 is more favorable for installation of other apparatuses at the bottom of the case body 100.

The projection of the inner tub 200 in the horizontal direction may also be less than the projection of the water collection cavity 400 in the horizontal direction, so that more water can be collected.

Further, the drainage pipe 401 is arranged on the mounting plate 500. One end of the drainage pipe 401 communicates with the water collection cavity 400, and the other end of the drainage pipe 401 is led out of the washing machine or communicates with a main drainage pipeline of the washing machine, so as to drain the water. Through the arrangement of the drainage pipe 401 for draining the water in the water collection structure in the water collection cavity 400, after the water is drained into the water collection cavity 400, the water in the water collection cavity 400 is drained out through the drainage pipe 401 to prevent overflow caused by excessive water in the water collection cavity 400.

Further, third drainage ports 201 and first drainage pipelines 202 communicating with the third drainage ports 201 are arranged on the tub wall of the inner tub 200. Water outlets 203 of the first drainage pipelines 202 are arranged above the upper opening of the water collection cavity 400. There are a plurality of third drainage ports 201 and a plurality of first drainage pipelines 202. Each third drainage port 201 corresponds to each first drainage pipeline 202, or the plurality of third drainage ports 201 correspond to one first drainage pipeline 202. When the washing machine is executing a spin-drying program, water thrown out by the centrifugal effect of the clothes washing tub 206 enters the first drainage pipelines 202 through the third drainage ports 201, and then is drained into the water collection cavity 400 through water outlets 203 of the first drainage pipelines 202, so as to be prevented from overflowing everywhere.

The water outlets 203 of the first drainage pipelines 202 are arranged above the upper opening of the water collection cavity 400. By making the water outlets 203 communicate with the water collection structure, during the spin-drying, the water enters the first drainage pipelines 202 through the third drainage ports 201, and then is drained into the water collection cavity 400 through the water outlets 203, so as to be prevented from overflowing. The water outlets 203 are arranged above the upper opening of the water collection cavity 400 defined by the water retaining bar 501, so that the water drained from the water outlets 203 directly falls into the water collection cavity 400. This structure is simpler, and is better in water collection effect without adding other additional components.

Further, the inner tub 200 further includes a second drainage port 204 for draining the water in the inner tub 200 into the water collection cavity 400 during dewatering and/or spin-drying. A blocking apparatus 205 is arranged between the second drainage port 204 and the water collection cavity 400. The blocking apparatus 205 opens the second drainage port 204 during the dewatering and/or spin-drying, so that a large amount of water in the inner tub 200 is drained out through the second drainage port 204. During clothes washing, the second drainage port 204 is blocked to retain the water in the inner tub 200 for clothes washing.

Further, the second drainage port 204 is arranged above the upper opening of the water collection cavity 400, and the blocking apparatus 205 is arranged at the lower part of the second drainage port 204.

Through the arrangement of the second drainage port 204, the blocking apparatus 205 opens the second drainage port 204 during the dewatering and/or spin-drying, so that the water in the inner tub 200 is directly drained into the water collection structure, and the water retaining bar 501 retains the water and prevents the water from overflowing, and the water is drained out of the washing machine through the drainage pipe 401. During clothes washing, the blocking apparatus 205 blocks the second drainage port 204 to retain the water in the inner tub 200 for clothes washing.

The washing machine is a pulsator washing machine.

The blocking apparatus 205 includes a valve plug 205-1 and an electromagnetic apparatus 205-2 arranged below the valve plug 205-1. The electromagnetic apparatus 205-2 is electrically connected with a control apparatus of the washing machine. When the washing machine is in a washing state, the valve plug 205-1 blocks the second drainage port 204 to prevent the water in the inner tub 200 from being drained. When the washing machine is in a drainage or dewatering state, the electromagnetic apparatus 205-2 controls the valve plug 205-1 to move downwards to open the second drainage port 204 to drain the water into the water collection structure.

A locating apparatus is arranged on the mounting plate 500. A matching portion cooperated with the locating apparatus is arranged on the bottom wall of the inner tub 200. The matching portion may be a locating groove. During the dewatering and/or spin-drying, the locating apparatus is separated from the matching portion, and the inner tub 200 rotates with an output shaft 303. When the washing machine is in the washing state, the locating apparatus is matched with the matching portion to lock the inner tub 200 on the mounting plate 500, and the valve plug 205-1 is just opposite to the second drainage port 204 to block the second drainage port 204, so as to prevent the water in the inner tub 200 from being drained out. The output shaft drives the pulsator in the washing machine to rotate.

Further, the mounting plate 500 is arranged between the inner tub 200 and a driving apparatus 300, and the lower part of the mounting plate 500 is fixedly connected with a shell of the driving apparatus 300. Through the arrangement of the mounting plate 500 between the inner tub 200 and the driving apparatus 300, on one hand, the water in the inner tub 200 may drop down by the self-weight and automatically flow into the water collection structure, and on the other hand, the mounting plate 500 is arranged at the upper part of the driving apparatus 300 to isolate the water from the driving apparatus 300, thus preventing the water from damaging the driving apparatus 300.

The driving apparatus 300 includes a motor 301. A decelerating clutch apparatus 302 is arranged above the motor 301. The lower part of the mounting plate 500 is fixedly connected with a shell of the decelerating clutch apparatus or the motor 301.

A connection mode between the mounting plate 500 and the driving apparatus 300 may also be that: the mounting plate 500 is connected with the output shaft 303 of the driving apparatus 300 through a bearing.

Further, the output shaft 303 of a decelerating clutch penetrates through the mounting plate 500, and is connected with the inner tub 200 to drive the inner tub 200 to rotate. The mounting plate 500 is connected with the output shaft 303 of the driving apparatus 300 through the bearing.

Embodiment III

As shown in FIGS. 1 to 4, a suspension type volume enlargement washing machine includes a case body 100, a clothes washing tub 206 arranged in the case body 100, and a driving apparatus 300. An output shaft 303 of the driving apparatus 300 is connected with the clothes washing tub 206 to drive the clothes washing tub 206 to rotate. The washing machine further includes suspended vibration absorption members 600 and a mounting piece 700 arranged below the clothes washing tub 206. The driving apparatus 300 is mounted on the mounting piece 700. One ends of the suspended vibration absorption members 600 are connected with the case body 100, and the other ends of the suspended vibration absorption members 600 are connected with the mounting piece 700.

The mounting piece 700 is arranged below the clothes washing tub 206, and the suspended vibration absorption members 600 are mounted on the mounting piece 700. Since the mounting piece 700 is lower than the clothes washing tub 206, longitudinal heights of mounting portions 701 are lowered, and an inclination angle θ between each mounted suspended vibration absorption member 600 and the side wall of the case body is reduced, and then space occupied by the suspended vibration absorption members 600 is reduced. When the structure is suspended between the clothes washing tub 206 and the case body 100, the diameter of the clothes washing tub 206 may be increased without enlarging the volume of the case body 100, thereby achieving the aim of volume enlargement.

The clothes washing tub 206 may be a clothes washing tub 206 only provided with an inner tub 200 that is used for accommodating water and washing clothes. The clothes washing tub 206 may also be a clothes washing tub 206 provided with an inner tub 200 and an outer tub.

Further, the mounting piece 700 includes the mounting portions 701 assembled with the suspended vibration absorption members 600, and the mounting portions 701 are not higher than the tub bottom of the clothes washing tub 206.

The mounting portions 701 are not higher than the tub bottom of the clothes washing tub 206, so as not to occupy the space between the clothes washing tub 206 and the case body 100, which may increase the diameter of the clothes washing tub 206 to achieve capacity enlargement.

Further, the mounting portions 701 are located below the tub bottom of the clothes washing tub 206. After the suspended vibration absorption members 600 are assembled with the mounting portions 701, since the mounting portions 701 are arranged to be lower than the tub bottom of the clothes washing tub 206, an inclination angle formed between each suspended vibration absorption member 600 and the case body 100 is decreased. That is, the suspended vibration absorption members 600 are better attached to the inner wall of the case body 100 to reserve larger space for the clothes washing tub 206, so that the aim of capacity enlargement may be achieved by increasing the diameter of the clothes washing tub 206.

Further, projections of the mounting portions 701 in a horizontal direction are located outside a projection of the clothes washing tub 206 in the horizontal direction.

Since the mounting portions 701 are arranged below the tub bottom of the clothes washing tub 206, and do not occupy the space between the clothes washing tub 206 and the case body 100, the mounting portions 701 would not collide with the clothes washing tub 206. In this premise, the mounting portions 701 are enabled to extend out of the tub wall of the clothes washing tub 206 in the horizontal direction to enable the projections of the mounting portion 701 in the horizontal direction to be located outside the projection of the clothes washing tub 206 in the horizontal direction, which further decreases the mounting space of the suspended vibration absorption members 600 and then increases the mounting space of the clothes washing tub 206 to achieve the capacity enlargement of the clothes washing tub 206.

Further, the output shaft 303 penetrates through the mounting piece 700, and is connected with the clothes washing tub 206 to drive the clothes washing tub 206 to rotate. The mounting piece 700 is connected with the output shaft 303 through bearing.

The mounting piece 700 may also be fixedly connected with a shell of the driving apparatus 300 to make the mounting piece 700, the driving apparatus 300 and the clothes washing tub 206 form a relatively independent whole. The mounting piece 700 may also be simultaneously fixedly connected with the shell of the driving apparatus 300 and connected with the output shaft 303 through a bearing to make the mounting piece 700, the driving apparatus 300 and the clothes washing tub 206 form a relatively independent whole.

The mounting piece 700 is connected with the output shaft 303 through the bearing and/or is fixedly connected with the shell of the driving apparatus 300 to make the mounting piece 700, the driving apparatus 300 and the clothes washing tub 206 form the relatively independent whole, so that the vibration of the mounting piece 700 is reduced through the vibration absorption member to reduce the vibrations of the clothes washing tub 206 and the driving apparatus 300, thus achieving a good vibration absorption effect.

The mounting piece 700 is of a centrosymmetric structure. There are a plurality of suspended vibration absorption members 600 uniformly distributed around the mounting piece 700.

By setting the mounting plate 500 to be a centrosymmetric structure, the possibility of deviation of the entire gravity center of the mounting plate 500, the clothes washing tub 206 and the motor 301 is lowered, thus achieving a better vibration absorption effect. The round mounting plate 500, on one hand, is favorable for mounting the driving apparatus 300, and on the other hand, makes the structure steadier.

Embodiment IV

As shown in FIGS. 1 to 4, the present embodiment is a further limitation to Embodiment III. In the present embodiment, the mounting piece 700 is a flat round mounting plate 500. The diameter of the mounting plate 500 is greater than the diameter of the clothes washing tub 206. The mounting plate 500 is arranged below the clothes washing tub 206. The lower ends of the suspended vibration absorption members 600 are assembled on the edge of the mounting plate 500 such that portions, connected with the mounting plate 500, of the suspended vibration absorption members 600 are located below the clothes washing tub 206 and outside the circumference of the clothes washing tub 206. That is, the mounting portions 701 are located obliquely below the tub bottom of the clothes washing tub 206 to reduce the suspension space of the suspended vibration absorption members 600, and then increase the space reserved for the clothes washing tub 206 without enlarging the volume of the case body 100.

The driving apparatus 300 is assembled at the lower part of the mounting plate 500. The output shaft 303 of the driving apparatus 300 penetrates through the mounting plate 500, and is connected with the mounting plate 500 through bearing.

There are four suspended vibration absorption members 600 uniformly distributed around the round mounting plate 500.

The vibration absorption members include suspenders 602 and vibration absorption units 601 for generating a damping force. One ends of the suspenders 602 are fixed at the upper part of the case body 100, and the other ends of the suspenders 602 penetrate through the mounting portions 701 and are connected with the vibration absorption units 601.

The vibration absorption units 601 are located below the mounting plate 500, so that the vibration absorption units 601 do not occupy the space between the case body 100 and the clothes washing tub 206 in the horizontal direction, which further reduces the limitation of the vibration absorption units 601 to the volume enlargement of the clothes washing tub 206.

The mounting mode of the vibration absorption members on the case body 100 and the mounting plate 500 may also be that: a mounting seat is arranged at the upper part of the case body 100. One ends of the suspenders 602 are connected with the mounting piece 700, and the other ends of the suspenders 602 penetrate through the mounting seat and are connected with the vibration absorption units 601.

The mounting piece 700 may also be a crossed mounting plate 500. The suspended vibration absorption members 600 are respectively connected with the edges of various branches of the crossed mounting plate 500. The mounting portions 701 for connecting the suspended vibration absorption members 600 with the crossed mounting plate 500 are lower than the tub bottom of the clothes washing tub 206, so that the suspended vibration absorption members 600 do not occupy the space between the clothes washing tub 206 and the case body 100, and the mounting portions 701 are lowered to reduce the mounting space of the suspended vibration absorption members 600 and achieve the volume enlargement of the clothes washing tub 206.

The mounting plate 500 may be a flat plate, or may be of a structure having a higher middle part and a lower edge, including, for example, a ring-like edge plate, a round center plate and a connection vertical plate for connecting the edge plate with the center plate. The cross section is of an "a" shape.

The mounting plate 500 may also be fixedly connected with a housing of the driving apparatus 300. Of course, the mounting plate 500 may also be simultaneously connected with the housing and the output shaft 303 through bearings.

Embodiment V

As shown in FIGS. 1 to 4, on the basis of Embodiment III and Embodiment IV, in the present embodiment, a vibration absorption apparatus includes a motor 301. A decelerating clutch is arranged on the motor. An output shaft 303 of the decelerating clutch is connected with the clothes washing tub 206 to drive the clothes washing tub 206 to rotate. The vibration absorption apparatus further includes first vibration absorption members 703. One ends of the first vibration absorption members 703 are movably connected with the mounting piece 700, and the other ends of the first vibration absorption members 703 are movably connected with the bottom of the case body 100. The first vibration absorption members 703 apply a downward pull force to the mounting piece 700, so that the mounting piece 700 is stressed by the downward pull force of the first vibration absorption members 703 and an upward pull force of the suspended vibration absorption members 600. Through a resultant force of the two forces, a better vibration absorption effect is achieved.

The mounting piece 700 is a round flat mounting plate 500. The suspended vibration absorption members 600 are connected with the upper part of the mounting plate 500, and the first vibration absorption members 703 are connected with the lower part of the mounting plate 500, so that the suspended vibration absorption members 600 and the first vibration absorption members 703 act on the mounting plate 500 at the same time to play a vibration absorption role on the mounting plate 500 and then achieve a vibration absorption effect on the clothes washing tub 206 and the motor 301.

In another solution of the mounting piece 700, the mounting piece 700 includes a big mounting plate 700-1 connected with the suspended vibration absorption members 600 and a small mounting plate 700-2 connected with the first vibration absorption members 703. The big mounting plate 700-1 and the small mounting plate 700-2 are connected through reinforcing bars to enhance the strength of the mounting piece. The reinforcing bars are spaced, so that the enhancement effect is better. Since the bottom wall of the case body 100 of the washing machine needs to be provided with reinforcing structure and other components, the diameter of the big mounting plate 700-1 is generally designed to be greater than the diameter of the small mounting plate 700-2 to provide space for the installation of other components. The separate arrangement saves more space below the mounting piece 700 and is more favorable for use.

Further, one ends of the first vibration absorption members 703 are hinged with the mounting piece 700, and the other ends of the first vibration absorption members 703 are hinged with the bottom of the case body 100.

Further, each first vibration absorption member 703 is a vibration absorber.

Further, the washing machine further includes second vibration absorption members 704 arranged on the driving apparatus 300. One ends of the second vibration absorption members 704 are fixedly connected with the driving apparatus 300, and the other ends of the second vibration absorption members 704 are fixedly connected to the bottom wall of the case body 100.

The second vibration absorption members 704 are arranged to apply a downward pull force or an upward elastic force to the driving apparatus 300. In combination with the first vibration absorption members 703 and the suspended vibration absorption members 600, the whole formed by the mounting plate 500, the driving apparatus 300 and the clothes washing tub 206 achieves a better vibration absorption effect under the combined action of the single components.

Further, one ends of the second vibration absorption members 704 are fixedly connected with a stator of the motor 301, and the other ends of the second vibration absorption members 704 are fixedly connected to the bottom wall of the case body 100.

Further, each second vibration absorption apparatus is a vibration absorption spring.

Further, the washing machine is also provided with a water collection structure, and the water collection structure is used for preventing water drained from the inner tub 200 from overflowing. The water collection structure is integrally located below the tub bottom of the inner tub 200. The water collection structure includes a water collection cavity 400 having an upper opening. The upper end of the side wall of the water collection cavity 400 is lower than the tub bottom of the inner tub 200. The inner tub 200 communicates with the upper opening of the water collection cavity 400.

Specifically, a water retaining bar 501 is arranged on the mounting plate 500. The mounting plate 500 and the water retaining bar 501 form the water collection cavity 400. By arranging the mounting plate 500 and the water retaining bar 501 and forming the water collection cavity 400 by the mounting plate 500 and the water retaining bar 501, the structure is simple and convenient to machine.

The water collection cavity 400 is located at the middle part of the mounting plate 500, so that the gravity center of a water retaining apparatus overlaps the center more easily, and an offset is reduced.

The water retaining bar 501 is in a ring shape, and the water retaining bar 501 and the mounting plate 500 define a ring-like water collection cavity 400.

Further, the water retaining bar 501 is inclined. By tilting the water retaining bar 501, the water retaining capacity may be increased to the maximum extent, and the use is more convenient.

Further, the water retaining bar 501 gradually contracts from top to bottom towards a center axis direction of the water collection cavity 400, so that the upper opening has a larger aperture, which is more favorable for collection.

Further, the outer wall of the bottom of the inner tub 200 is an arc-shaped surface, and a certain distance is reserved between the water retaining bar 501 and the arc-shaped surface of the inner tub 200.

Further, a projection of the inner tub 200 in a horizontal direction covers a projection of the water collection cavity 400 in the horizontal direction. Since the projection of the inner tub 200 in the horizontal direction covers the projection of the water collection cavity 400 in the horizontal direction, the distance between the water collection cavity 400 and the case body 100 is prolonged, so as to prevent the collision of the water collection cavity 400 to the case body 100 and reduce damage to the water collection cavity 400. Meanwhile, the small water collection cavity 400 is more favorable for installation of other apparatuses at the bottom of the case body 100.

The projection of the inner tub 200 in the horizontal direction may also be less than the projection of the water collection cavity 400 in the horizontal direction, so that more water can be collected.

Further, the drainage pipe 401 is arranged on the mounting plate 500. One end of the drainage pipe 401 is communicated with the water collection cavity 400, and the other end of the drainage pipe 401 is led out of the washing machine or communicates with a main drainage pipeline of the washing machine, so as to drain the water. Through the arrangement of the drainage pipe 401 for draining the water in the water collection structure in the water collection cavity 400, after the water is drained into the water collection cavity 400, the water in the water collection cavity 400 is drained out through the drainage pipe 401 to prevent overflow caused by excessive water in the water collection cavity 400.

Further, third drainage ports 201 and first drainage pipelines 202 communicating with the third drainage ports 201 are arranged on the tub wall of the inner tub 200. Water outlets 203 of the first drainage pipelines 202 are arranged above the upper opening of the water collection cavity 400. There are a plurality of third drainage ports 201 and a plurality of first drainage pipelines 202. Each third drainage port 201 corresponds to each first drainage pipeline 202, or the plurality of third drainage ports 201 correspond to one first drainage pipeline 202. When the washing machine is executing a spin-drying program, water thrown out by the centrifugal effect of the clothes washing tub 206 enters the first drainage pipelines 202 through the third drainage ports 201, and then is drained into the water collection cavity 400 through water outlets 203 of the first drainage pipelines 202, so as to be prevented from overflowing everywhere.

The water outlets 203 of the first drainage pipelines 202 are arranged above the upper opening of the water collection cavity 400. By enabling the water outlets 203 to communicate with the water collection structure, during the spin-drying, the water enters the first drainage pipelines 202 through the third drainage ports 201, and then is drained into the water collection cavity 400 through the water outlets 203, so as to be prevented from overflowing. The water outlets 203 are arranged above the upper opening of the water collection cavity 400 defined by the water retaining bar 501, so that the water drained from the water outlets 203 directly falls into the water collection cavity 400. This structure is simpler, and is better in water collection effect without adding other additional components.

Further, the inner tub 200 further includes a second drainage port 204 for draining the water in the inner tub 200 into the water collection cavity 400 during dewatering and/or spin-drying. A blocking apparatus 205 is arranged between the second drainage port 204 and the water collection cavity 400. The blocking apparatus 205 opens the second drainage port 204 during the dewatering and/or spin-drying, so that a large amount of water in the inner tub 200 is drained out through the second drainage port 204. During clothes washing, the second drainage port 204 is blocked to retain the water in the inner tub 200 for clothes washing.

Further, the second drainage port 204 is arranged above the upper opening of the water collection cavity 400, and the blocking apparatus 205 is arranged at the lower part of the second drainage port 204.

Through the arrangement of the second drainage port 204, the blocking apparatus 205 opens the second drainage port 204 during the dewatering and/or spin-drying, so that the water in the inner tub 200 is directly drained into the water collection structure, and the water retaining bar 501 retains the water and prevents it from overflowing, and the water is drained out of the washing machine through the drainage pipe 401. During clothes washing, the blocking apparatus 205 blocks the second drainage port 204 to retain the water in the inner tub 200 for clothes washing.

The washing machine is a pulsator washing machine.

The blocking apparatus 205 includes a valve plug 205-1 and an electromagnetic apparatus 205-2 arranged below the valve plug 205-1. The electromagnetic apparatus 205-2 is electrically connected with a control apparatus of the washing machine. When the washing machine is in a washing state, the valve plug 205-1 blocks the second drainage port 204 to prevent the water in the inner tub 200 from being drained. When the washing machine is in a drainage or dewatering state, the electromagnetic apparatus 205-2 controls the valve plug 205-1 to move downwards to open the second drainage port 204 to drain the water into the water collection structure.

A locating apparatus is arranged on the mounting plate 500. A matching portion matched with the locating apparatus is arranged on the bottom wall of the inner tub 200. The matching portion may be a locating groove. During the dewatering and/or spin-drying, the locating apparatus is separated from the matching portion, and the inner tub 200 rotates with an output shaft 303. When the washing machine is in the washing state, the locating apparatus is matched with the matching portion to lock the inner tub 200 on the mounting plate 500, and the valve plug 205-1 is just opposite to the second drainage port 204 to block the second drainage port 204, so as to prevent the water in the inner tub 200 from being drained out. The output shaft drives the pulsator in the washing machine to rotate.

Further, the mounting plate 500 is arranged between the inner tub 200 and a driving apparatus 300, and the lower part of the mounting plate 500 is fixedly connected with a shell of the driving apparatus 300. Through the arrangement of the mounting plate 500 between the inner tub 200 and the driving apparatus 300, on one hand, the water in the inner tub 200 may drop down by its gravity and automatically flow into the water collection structure, and on the other hand, the mounting plate 500 is arranged at the upper part of the driving apparatus 300 to isolate the water from the driving apparatus 300, thus preventing the water from damaging the driving apparatus 300.

The driving apparatus 300 includes a motor 301. A decelerating clutch apparatus 302 is arranged above the motor 301. The lower part of the mounting plate 500 is fixedly connected with a shell of the decelerating clutch apparatus or the motor 301.

A connection mode between the mounting plate 500 and the driving apparatus 300 may also be that: the mounting plate 500 is connected with the output shaft 303 of the driving apparatus 300 through a bearing.

Further, the output shaft 303 of the decelerating clutch penetrates through the mounting plate 500, and is connected with the inner tub 200 to drive the inner tub 200 to rotate. The mounting plate 500 is connected with the output shaft 303 of the driving apparatus 300 through the bearing.

The above descriptions are only preferred embodiments of the present disclosure, but not intended to limit the present disclosure in any forms. Although the present disclosure is disclosed above by the preferred embodiments, the preferred embodiments are not intended to limit the present disclosure. Any person skilled in the art can make some changes by using the above-mentioned technical contents or modify the technical contents as equivalent embodiments of equivalent changes without departing from the scope of the technical solution of the present disclosure. Any simple alterations, equivalent changes and modifications that are made to the above embodiments according to the technical essence of the present disclosure without departing from the contents of the technical solution of the present disclosure shall all fall within the scope of the solution of the present disclosure.

The invention claimed is:

1. A washing machine, comprising:

an inner tub for accommodating water;

a water collection structure for stopping water drained out of the inner tub from overflowing;

a drainage structure for draining the water in the water collection structure; and suspended vibration absorption members, wherein the inner tub includes a tub body and a tub bottom arranged at a lower part of the tub body, and the water collection structure is located outside the tub bottom of the inner tub, the water collection structure includes a mounting plate and a water retaining bar arranged on the mounting plate, the mounting plate is located below the tub bottom of the inner tub, a water collection cavity is formed by the mounting plate and the water retaining bar, and lower ends of the suspended vibration absorption members are arranged on the mounting plate, and portions of the suspended vibration absorption members connected with the mounting plate, are located below the tub bottom of the inner tub and outside a circumference of the inner tub.

2. The washing machine according to claim 1, wherein the water collection structure is located below the tub bottom of the inner tub, and the drainage structure is in a normally-open state.

3. The washing machine according to claim 2, wherein the water collection cavity has an upper opening, an upper end of a side wall of the water collection cavity is lower than the tub bottom of the inner tub, the inner tub is communicated with the upper opening of the water collection cavity, and the drainage structure comprises a drainage pipe, the drainage pipe is connected with a wall of the water collection cavity, and the upper opening of the water collection cavity is higher than a highest point of the drainage pipe.

4. The washing machine according to claim 3, wherein a first drainage outlet for draining the water in the water collection cavity is formed in the mounting plate, and a water inlet end of the drainage pipe is communicated with the first drainage outlet, and an upper end of the water retaining bar is higher than the highest point of the drainage pipe.

5. The washing machine according to claim 3, wherein a junction of the drainage structure and the water collection structure is higher than the highest point of the drainage pipe, and the water in the water collection structure is drained out of the washing machine under the action of gravity.

6. The washing machine according to claim 4, wherein the water inlet end of the drainage pipe is connected with a bottom wall of the water collection cavity, a water outlet end of the drainage pipe extends out of the washing machine, and the water inlet end of the drainage pipe is higher than the water outlet end of the drainage pipe.

7. The washing machine according to claim 3, wherein a junction of the water collection structure and the drainage structure is provided with a buffering cavity for buffering and reducing the speed of water flow entering the drainage pipe from the water collection structure.

8. The washing machine according to claim 7, wherein the bottom wall of the water collection cavity is downwards sunk to form the buffering cavity, and the first drainage outlet is formed in a wall of the buffering cavity.

9. The washing machine according to claim 8, wherein the side wall of the buffering cavity is an inclined plane and is gradually shrunk towards an axis direction of the buffering cavity along water flow direction.

10. The washing machine according to claim 7, wherein the drainage pipe comprises the water inlet end and a body, and a diameter of the water inlet end is larger than a diameter of the body to form the buffering cavity at the water inlet end of the drainage pipe.

11. The washing machine according to claim 3, wherein the washing machine further comprises a main control apparatus and a normally-open electromagnetic valve, the normally-open electromagnetic valve is arranged on the drainage pipe and communicated with the drainage pipe, and the normally-open electromagnetic valve is electrically connected with the main control apparatus.

12. The washing machine according to claim 3, wherein the drainage pipe is connected with a bottom wall of the water collection cavity and keeps a normally-open state.

13. The washing machine according to claim 4, wherein a junction of the drainage structure and the water collection structure is higher than the highest point of the drainage pipe, and the water in the water collection structure is drained out of the washing machine under the action of gravity.

14. The washing machine according to claim 4, wherein the first drainage outlet is higher than the highest point of the drainage pipe.

15. The washing machine according to claim 6, wherein a height of the drainage pipe is gradually reduced from the water inlet end to the water outlet end.

16. The washing machine according to claim 7, wherein the buffering cavity is arranged at a junction of the water collection cavity and the drainage pipe.

17. The washing machine according to claim 8, wherein the bottom wall of the water collection cavity is downwards sunk to form the buffering cavity provided with a bottom wall and a side wall, and the first drainage outlet is formed in the bottom wall of the buffering cavity.

18. The washing machine according to claim 8, wherein the diameter of the water inlet end is gradually shrunk along the water flow direction up to the diameter of the body to form the inclined plane.

* * * * *